US008727564B2

(12) United States Patent
Watanabe

(10) Patent No.: US 8,727,564 B2
(45) Date of Patent: May 20, 2014

(54) ILLUMINATION APPARATUS

(75) Inventor: Hiroaki Watanabe, Yokosuka (JP)

(73) Assignees: Toshiba Lighting & Technology Corporation, Kanagawa (JP); Kabushiki Kaisha Toshiba, Tokyo (JP)

( * ) Notice: Subject to any disclaimer, the term of this patent is extended or adjusted under 35 U.S.C. 154(b) by 482 days.

(21) Appl. No.: 13/013,363

(22) Filed: Jan. 25, 2011

(65) Prior Publication Data

US 2011/0182067 A1 Jul. 28, 2011

(30) Foreign Application Priority Data

Jan. 26, 2010 (JP) ..... 2010-014706
Jan. 29, 2010 (JP) ..... 2010-018693

(51) Int. Cl.
*F21S 8/00* (2006.01)

(52) U.S. Cl.
USPC ..... 362/235; 362/545; 362/548

(58) Field of Classification Search
USPC ..... 362/235, 545, 548, 373, 249.02, 646
See application file for complete search history.

(56) References Cited

U.S. PATENT DOCUMENTS

| | | | | |
|---|---|---|---|---|
| 4,935,665 | A * | 6/1990 | Murata | 313/500 |
| 6,367,949 | B1 | 4/2002 | Pederson | |
| 2008/0273326 | A1 | 11/2008 | Wilcox | |

FOREIGN PATENT DOCUMENTS

| | | |
|---|---|---|
| CN | 200946777 | 9/2007 |
| CN | 200979136 | 11/2007 |
| CN | 201074793 | 6/2008 |
| CN | 101349419 | 1/2009 |
| CN | 101398162 | 4/2009 |
| JP | 2006-294526 | 10/2006 |
| JP | 2007-087712 | 4/2007 |
| JP | 2009-170126 | 7/2009 |
| JP | 2010-010134 | 1/2010 |
| WO | WO 2008/108832 | 9/2008 |
| WO | WO 2008/137618 | 11/2008 |

OTHER PUBLICATIONS

European Search Report issued in EP 11152025.0 on Mar. 14, 2013.
Chinese Office Action issued in CN 201110031442.9 dated Apr. 3, 2013.
English Language Translation of Chinese Office Action issued in CN 201110031442.9 dated Apr. 3, 2013.
Japanese Office Action issued in JP 2010-014706 on May 1, 2013.
English Language Translation of Japanese Office Action issued in JP 2010-014706 on May 1, 2013.
English Language Abstract of JP 2007-087712 published Apr. 5, 2007.
English Language Translation of JP 2007-087712 published Apr. 5, 2007.

(Continued)

*Primary Examiner* — Sharon Payne
(74) *Attorney, Agent, or Firm* — DLA Piper LLP (US)

(57) ABSTRACT

According to one embodiment, an illumination apparatus is provided with a substrate, a radiator, a lens, a lens holder and a metal component. A wiring layer is formed on the front face of the substrate and semiconductor light emitting elements are mounted on the wiring layer. The rear face of the substrate is attached to the radiator. The lens controls light emitted from the semiconductor light emitting elements. The lens holder is made insulative. The lens holder is provided with a holder portion for holding the lens and an attachment base to be attached to the radiator by way of the substrate. The metal component is attached to the radiator from the front face of the attachment base of the lens holder by way of the attachment base.

8 Claims, 7 Drawing Sheets

(56) References Cited

OTHER PUBLICATIONS

English Language Abstract of JP 2009-170126 published Jul. 30, 2009.
English Language Translation of JP 2009-170126 published Jul. 30, 2009.
English Language Abstract of JP 2010-010134 published Jan. 14, 2013.
English Language Translation of JP 2010-010134 published Jan. 14, 2013.
Chinese Office Action issued in CN 201110031442.9 dated Aug. 3, 2012.
English Language Translation of Chinese Office Action issued in CN 201110031442.9 dated Aug. 3, 2012.
English Language Abstract of CN 101398162 published Apr. 1, 2009.
English Language Abstract of CN 101349419 published Jan. 21, 2009.
English Language Abstract of CN 201074793 published Jun. 18, 2008.
English Language Abstract of CN 200979136 published Nov. 21, 2007.
English Language Abstract of CN 200946777 publised Sep. 12, 2007.
English Language Abstract of JP 2006-294526 published Oct. 26, 2006.
English Language Translation of JP 2006-294526 published Oct. 26, 2006.
Japanese Office Action issued in JP 2010-014706 on Jun. 19, 2013.
English Language Translation of Japanese Office Action issued in JP 2010-014706 on Jun. 19, 2013.

* cited by examiner

ILLUMINATION APPARATUS

INCORPORATION BY REFERENCE

The present invention claims priority under 35 U.S.C. §119 to Japanese Patent Application Nos. 2010-014706 and 2010-018693 filed on Jan. 26, 2010 and Jan. 29, 2010, respectively. The contents of these applications are incorporated herein by reference in their entirety.

FIELD

Embodiments described herein relate to an illumination apparatus which uses a semiconductor light emitting element as a light source.

BACKGROUND

An illumination apparatus, for example a spotlight used for illuminating an article on display, may use an LED (light emitting diode) as a light source. An LED illumination apparatus includes a substrate on which a plurality of LEDs are mounted, a plurality of lenses which project light from the individual LEDs, and a lamp body having a main body which accommodates the substrate and the lenses.

The substrate is made of metal higher in thermal conductivity. An insulating layer is formed on the front face of the substrate, a wiring layer patterned in a predetermined manner is formed on the insulating layer, and a plurality of LEDs are mounted on the wiring layer. The rear face of the substrate is attached to a radiator of the main body so that heat generated by the LEDs on lighting can be conducted from the substrate to the radiator and released from the radiator.

In order to efficiently conduct the heat from the substrate to the radiator, the substrate is fastened and fixed to the radiator with a screw, by which the substrate is firmly attached to the radiator. The shank of the screw penetrates through the substrate from the front face of the substrate and is screwed into the radiator, and the head of the screw is joined to the front face of the substrate.

However, although current-carrying parts such as the wiring layer and the plurality of LEDs are arranged on the front face of the substrate, it is necessary to provide a clearance greater than a predetermined insulation distance between the current-carrying parts and the screw.

In a conventional illumination apparatus, since the head of a screw is directly joined to a substrate, it is necessary to secure an insulation distance from the current-carrying parts on the basis of an outermost diameter portion of the head of the screw. Therefore, for example, where the screw is arranged between a plurality of LEDs mounted on the substrate, the screw is arranged such that the LEDs are spaced away from each other so as to give a clearance greater than a predetermined insulation distance from the outermost diameter portion of the head of the screw. Thus, the substrate is large and the illumination apparatus is increased in size accordingly.

An object of the present invention is to provide an illumination apparatus which can be downsized.

DETAILED DESCRIPTION

The illumination apparatus of the present embodiment is provided with a substrate, a radiator, a lens, a lens holder and a metal component. A wiring layer is formed on the front face of the substrate, and semiconductor light emitting elements are mounted on the wiring layer. The rear face of the substrate is attached to the radiator. The lens controls light emitted from the semiconductor light emitting elements. The lens holder is made insulative. The lens holder is provided with a holder portion for holding the lens and an attachment base to be attached to the radiator by way of the substrate. The metal component is attached to the radiator from the front face of the attachment base of the lens holder by way of the attachment base.

The semiconductor light emitting element includes, for example, an LED chip element or an EL (electroluminescence) element. A single semiconductor light emitting element or a plurality of semiconductor light emitting elements may be installed.

The substrate is made of metal such as aluminum or ceramics having thermal conductivity, and the front face thereof is provided on an insulating layer with a wiring layer patterned in a predetermined manner. Semiconductor light emitting elements are mounted on the wiring layer. The wiring layer is made of copper, for example, and formed at a wide range on the substrate so as to increase the heat releasing efficiency and heat conductivity to the substrate main body.

The radiator is made of metal such as aluminum. It is preferable that the front face portion thereof is installed in a flat shape so that the substrate is in surface contact, thereby increasing the thermal conductivity. The radiator may be provided at the rear with a heat releasing structure.

The lens is made of a synthetic resin or glass, for example, and where a plurality of semiconductor light emitting elements are used, a plurality of lenses are used.

The attachment base of the lens holder may be formed in such a shape that a part of the attachment base is in contact with the substrate and a remaining part thereof is spaced away from the substrate. Alternatively, it may be formed in a plate shape so that an approximately whole part of the rear face of the attachment base is in contact with the substrate.

The metal component includes, for example, a screw for attaching the substrate and the lens holder to the radiator and a ground terminal for connecting a ground wire to the radiator. In the case of a screw, the screw is screwed into the radiator by way of the attachment base of the lens holder from the front face of the attachment base to attach the lens holder. In the case of a ground terminal, the ground terminal is connected by using a screw or the like to the radiator by way of the attachment base of the lens holder from the front face of the attachment base.

Next, a description will be given of the first embodiment with reference to FIG. 1 through FIG. 6.

Figure 6:
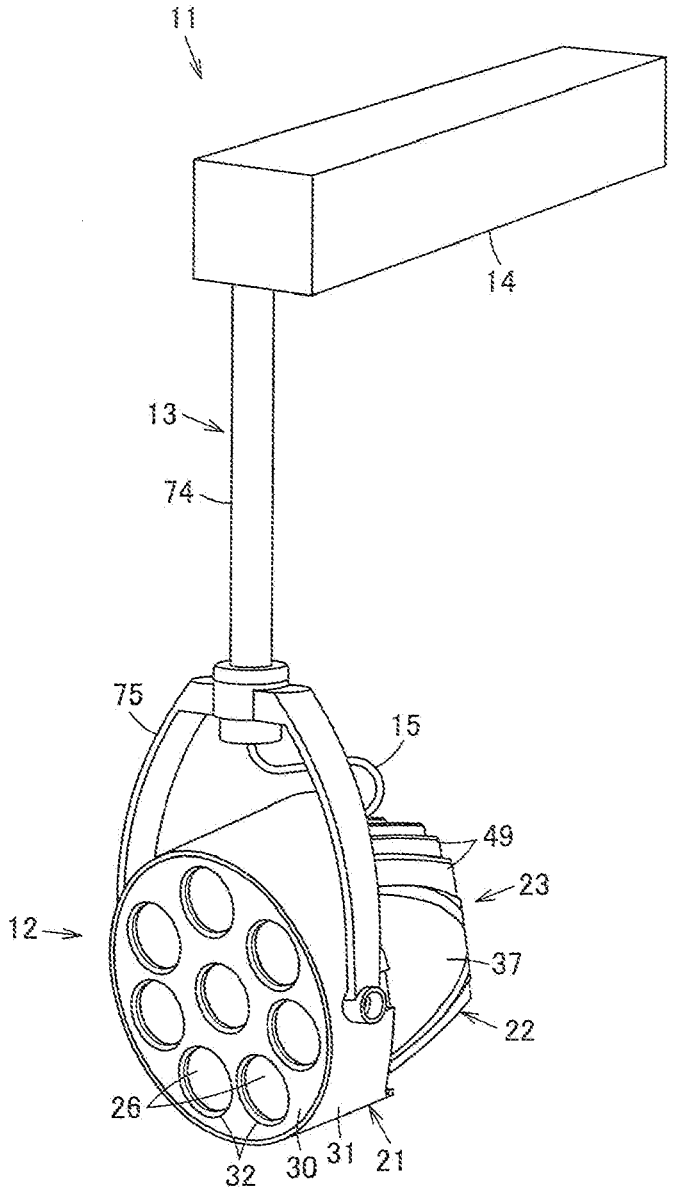
FIG. 6 is a perspective view which shows the illumination apparatus which is in a state of installation.

As shown in FIG. 6, ah illumination apparatus 11 is provided with a lamp body (an illumination apparatus main body) 12, a supporter 13 for supporting the lamp body 12, a power source unit 14 to which the supporter 13 is attached and which accommodates a lighting circuit (not illustrated) and an electric wire 15 which electrically connects the lighting circuit of the power source unit 14 with the lamp body 12.

Figure 1:
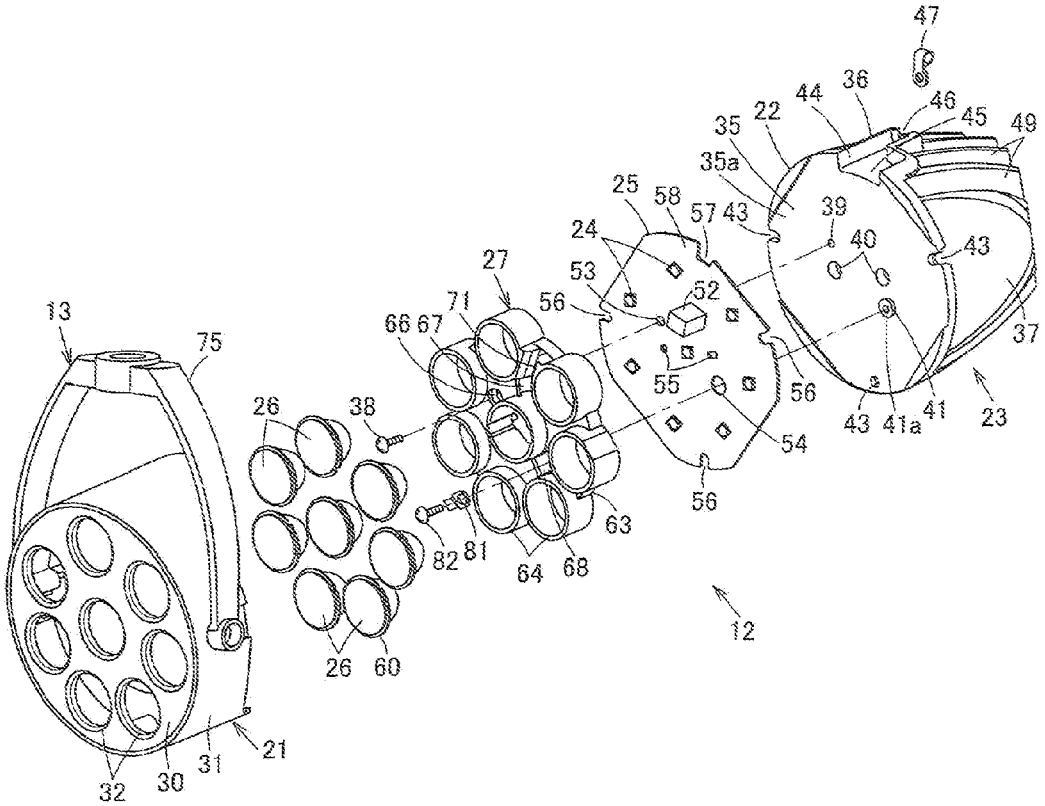
FIG. 1 is an exploded perspective view which shows an illumination apparatus of a first embodiment.

As shown in FIG. 1, the lamp body 12 is provided with a main body 23 having a cover 21 on the front face and a radiator 22 attached at the rear of the cover 21, a substrate 25 on which LEDs 24 as a plurality of semiconductor light emitting elements are mounted, a plurality of lenses 26 which project light emitted from each of the LEDs 24 to the front of the lamp body 12, and a lens holder 27 which holds each of the lenses 26 between the cover 21 and the lens holder 27.

The cover 21 is made of a synthetic resin or metal, for example, and provided with a circular front face plate 30 and a cylindrical cover portion 31 protruding rearward from the periphery of the front face plate 30. And, the both sides of the cover portion 31 are supported so as to be adjustable for a vertical angle by a horizontal shaft with respect to the supporter 13. The front face plate 30 is provided with a plurality of lens fitting holes 32 into which the individual lenses 26 are fitted and arranged from the rear.

Further, the radiator 22 is made of metal such as aluminum and provided with a flat plane-like front face portion 35 to which the substrate 25 is attached so as to be in surface contact therewith, an external face portion 36 which is a circumferential face adjacent to the front face portion 35 and a heat releasing portion 37 which protrudes to the rear.

The front face portion 35 is provided with a recess 35*a* into which the substrate 25 is fitted for positioning.

In the vicinity of the center of the front face portion 35, there is formed a screw attachment hole 39 into which a screw 38 is screwed as a metal component for fastening the substrate 25 and the lens holder 27 and fixing them together with the radiator 22, there are also formed a plurality of relief holes 40 which allow a part of the lens holder 27 to enter for positioning, and there is protruded a ground-wire attachment boss 41 having a ground-wire attachment hole 41*a* as a ground-wire attachment portion. The ground-wire attachment boss 41 protrudes from the front face portion 35 at a distance greater than the thickness of the substrate 25.

There are formed at the periphery of the front face portion 35 a plurality of attachment portions 43 constituted with grooves and holes into which a plurality of screws 42 (refer to FIG. 5) for fixing the cover 21 are inserted.

Figure 3:
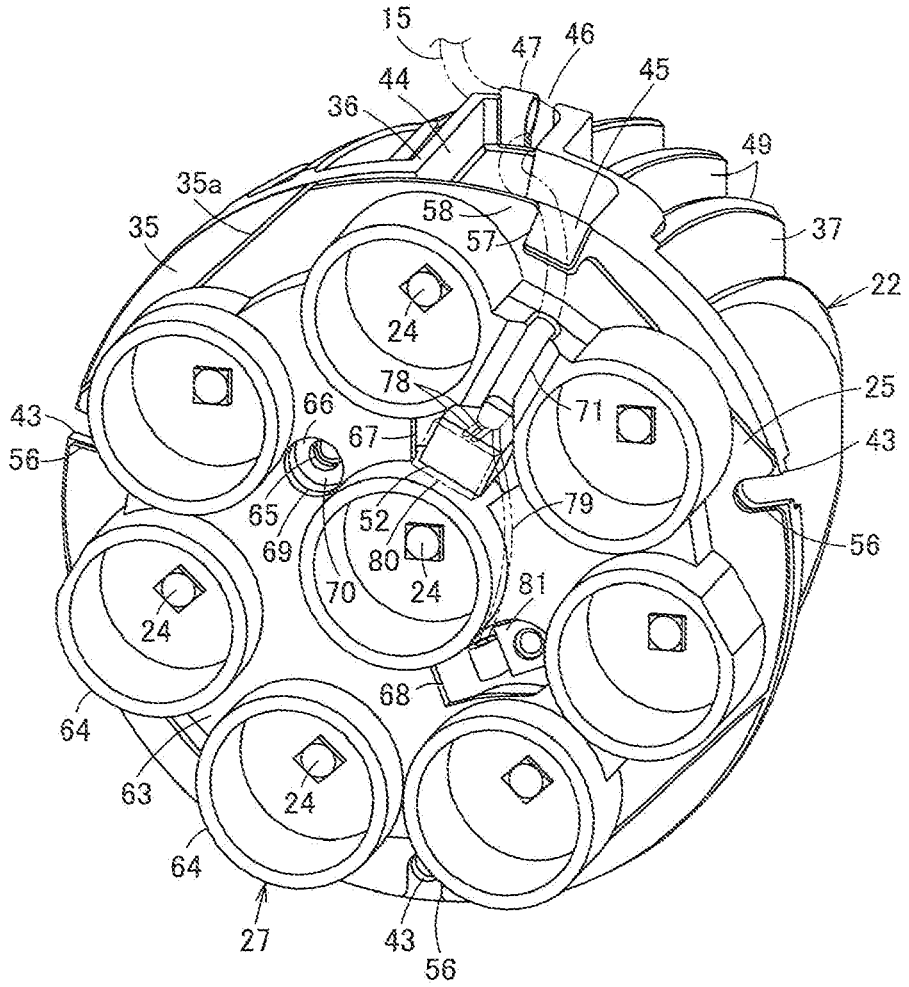
FIG. 3 is a perspective view in which a part of the illumination apparatus is viewed from the front.
Figure 5:
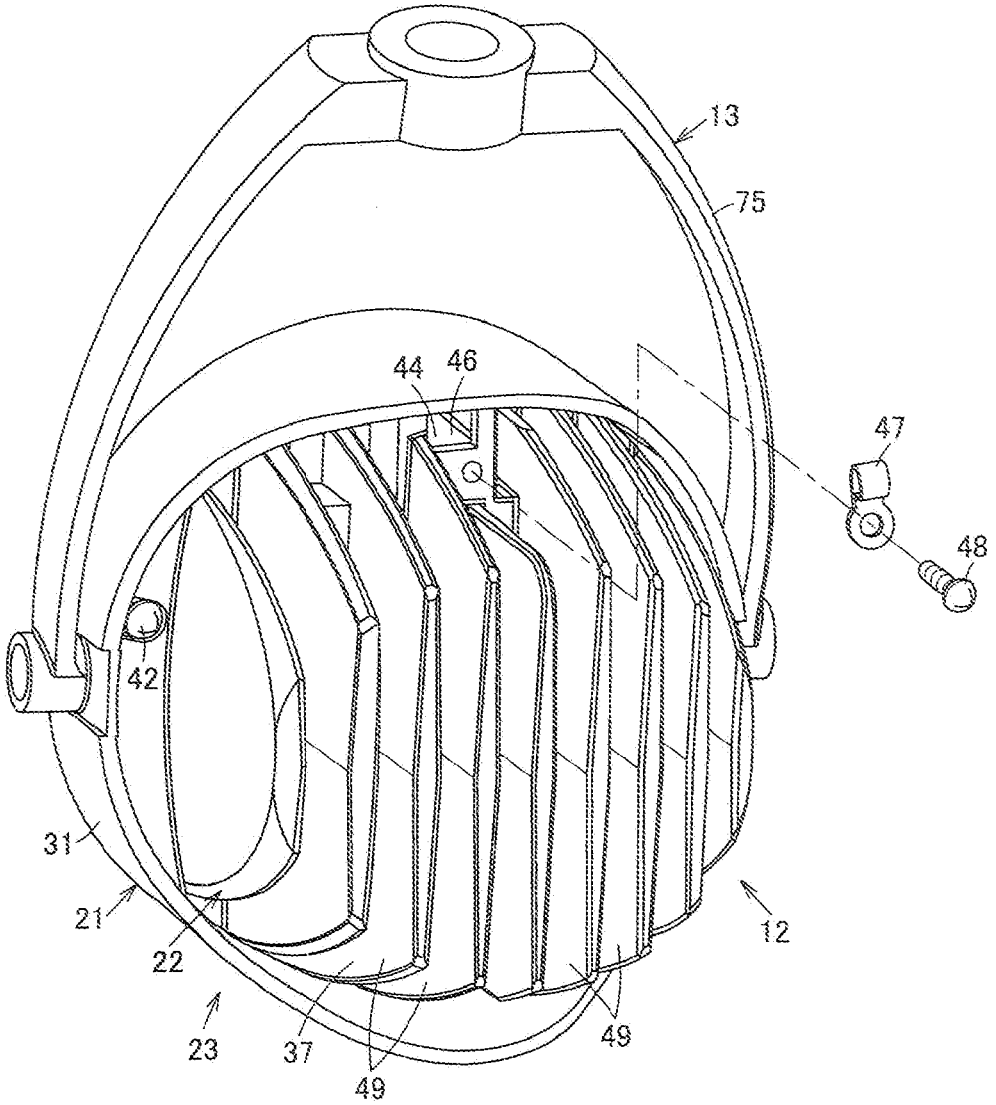
FIG. 5 is a perspective view when the illumination apparatus is viewed from the back.

A wiring groove 44 which communicatively connects from the external face portion 36 to the front face portion 35 is formed at the external face portion 36 at an upper part of the radiator 22. The wiring groove 44 is for arranging the electric wire 15 which is drawn inside from outside the main body 23 and electrically connected to the substrate 25. As shown in FIG. 1, FIG. 3 and FIG. 5, the wiring groove 44 is provided with a front face opening 43 which is opened at the front face portion 35 of the radiator 22 and a rear face opening 46 opened at the rear of the radiator 22. An entire region of the external face of the wiring groove 44, that is, an entire region of the upper face, is opened. The width of the wiring groove 44 is wider at the front than at the rear, and the wiring groove 44 is formed approximately in an L-letter shape when viewed from above.

An electric wire holder 47 for holding the electric wire 15 arranged at the wiring groove 44 is attached by using a screw 48 on the rear face of the radiator 22 below the wiring groove 44.

A plurality of heat releasing fins 49 which are arranged so as to provide a predetermined clearance in the horizontal direction are formed at the heat releasing portion 37 vertically. A space between the heat releasing fins 49 is opened both rearwardly and vertically, by which air is allowed to circulate.

Figure 4:
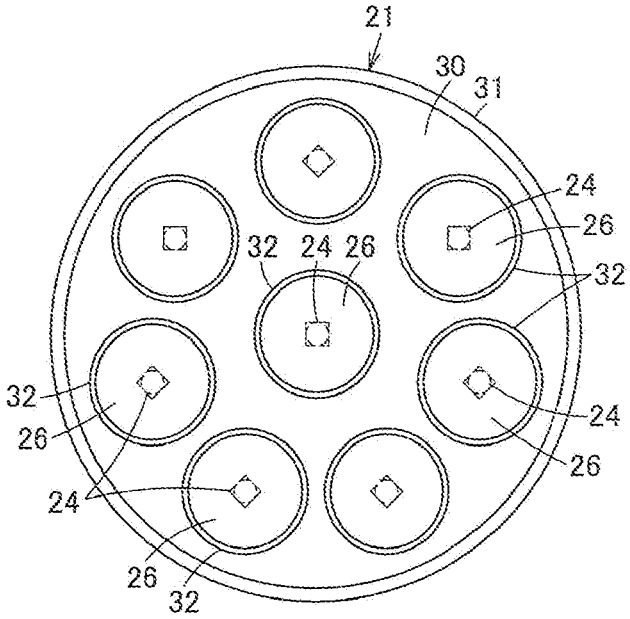
FIG. 4 is a front view which shows a main body of the illumination apparatus.

Further, as shown in FIG. 1, FIG. 3 and FIG. 4, as the LED 24, there is used a connection terminal-equipped SMD (surface mount device) package on which an LED chip is loaded. The SMD package is provided internally with an LED chip which emits blue light, for example, and the LED chip is sealed by using a sealing resin, for example, a silicone resin into which is mixed a yellow fluorescent material excited by a part of blue light from the LED chip to radiate yellow light. Therefore, the surface of the sealing resin acts as a light emitting face and light of white electroluminescence is radiated from the light emitting face. A terminal soldered and connected to the substrate 25 is arranged on a side face of the SMD package.

Still further, the substrate 25 is provided with a substrate main body made of metal such as aluminum or ceramics having thermal conductivity. An insulating layer (not illustrated) made of a resin, for example, is formed at the front face of the substrate main body, and a wiring layer patterned in a predetermined manner by using copper is formed on the insulating layer. A connector 52 for connecting the LED 24 and the electric wire 15 is connected and arranged on the wiring layer. The wiring layer functions not only to electrically connect the LED 24 and the connector 52 but also to conduct heat from the LED 24 to the substrate main body. Therefore, the wiring layer is formed at a wider surface range which occupies a substantial part of the front face of the substrate main body in order to improve the thermal conductivity to the substrate main body.

As shown in FIG. 4, a plurality of LEDs 24 which are mounted on the substrate 25 are arranged in such a manner that one of them is placed at the center of the substrate 25 and a plurality, for example, seven of them are individually placed at the periphery. These LEDs 24 are mounted more densely below (a lower half region) the center of the substrate 25 than above (an upper half region) the center. More specifically, the plurality of LEDs 24 mounted at the periphery of the substrate 25 are spaced narrowly in the circumferential direction below the center of the substrate 25 but spaced widely above the center. Further, regarding the number of the LEDs 24, four of them are placed below the center of the substrate 25, whereas three of them are placed above the center. The number of the LEDs placed below the center is greater. Thus, a value of light flux emitted from the front face of the cover 21 is greater below the center than above.

The substrate 25 is provided with a screw insertion hole 53 into which the screw 38 for fastening the substrate 25 and the lens holder 27 and fixing them together to the front face portion 35 of the radiator 22 is inserted, a boss insertion hole 54 into which the ground-wire attachment boss 41 of the radiator 22 is inserted, and a plurality of positioning holes 55 for positioning the lens holder 27.

At the periphery of the substrate 25, there are formed a plurality of screw insertion grooves 56 into which the screw 42 for fixing the cover 21 and the radiator 22 is inserted. An electric wire insertion groove 57 which opposes to and communicatively connects with the wiring groove 44 of the radiator 22 is formed at an upper part of the substrate 25, and a covering portion (a light shielding portion) 58 which opposes to and blocks the wiring groove 44 of the radiator 22 is formed on the side of the electric wire insertion groove 57. The electric wire insertion groove 57 is arranged at such a position that will not oppose to the rear face opening 96 of the wiring groove 94, whereas the covering portion 58 is arranged at such a position that will oppose to the rear face opening 46 of the wiring groove 44. Therefore, the front face opening 45 of the wiring groove 94 is constituted as an actual front face opening 45 through which the electric wire 15 passes at a part corresponding to the electric wire insertion groove 57 of the substrate 25 and constituted in such a manner that the front face opening 45 of the wiring groove 44 will not directly oppose to the rear face opening 46 thereof.

Further, the lens 26 is made of a transparent synthetic resin or glass, for example. The rear face of the lens 26 is formed as an incident surface on which light emitted from the LED 29 is made incident into the lens 26, whereas the front face thereof is formed as an exit surface from which light passing through the lens 26 exits forward. At the periphery of the lens 26, there is formed a flange 60 which is held between the lens fitting hole 32 of the cover 21 and the lens holder 27 and retained accordingly.

Still further, the lens holder 27 is provided with an attachment base 63 attached to the front face of the substrate 25 and a plurality of cylindrical holder portions 64 integrally installed on the attachment base 63.

Around the central holder portion 64 and between the same and the holder portions 64 at the periphery, the attachment base 63 is provided with a screw attachment portion 66 as a metal component attachment portion which has a screw insertion hole 65 into which the screw 38 for fastening the lens holder 27 and the substrate 25 and fixing them together with the radiator 22 is inserted, a connector connecting opening 67 which is opened opposing to the connector 52 of the substrate 25, and a ground-wire attaching opening 68 which is opened opposing to the ground-wire attachment boss 41 of the radiator 22 inserted into the boss insertion hole 54 of the substrate 25.

Figure 2:
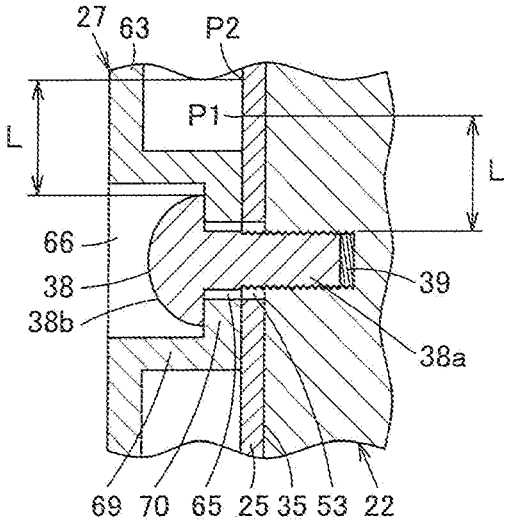
FIG. 2 is a partial cross sectional view of the illumination apparatus.

As shown in FIG. 2, the screw attachment portion 66 is provided with a cylindrical enclosing portion 69 by which the periphery of a head 38*b* of the screw 38 is enclosed and an intervention portion 70 which is placed between the head 38*b* of the screw 38 and the substrate 25 at the bottom of the enclosing portion 69. At the center of the intervention portion 70, there is formed a screw insertion hole 65 through which a shank (screw shank) 38*a* of the screw 38 is inserted. The intervention portion 70 is fastened by the screw 38 and firmly attached to the front face of the substrate 25, thereby being fastened and fixed to the radiator 22 together with the substrate 25.

Further, there is formed at an upper part of the lens holder 27 an electric wire retaining groove 71 by which the electric wire 15 wired by way of the front face of the lens holder 27 from the electric wire insertion groove 57 to the connector 52 is fitted and retained between the electric wire insertion groove 57 of the substrate 25 and the connector 52 and also between adjacent holder portions 64 of the lens holder 27.

A plurality of positioning protrusions (not illustrated) which are fitted into individual positioning holes 55 on the substrate 25 for positioning are protruded at the rear face of the attachment base 63 opposing to the substrate 25.

Each holder portion 64 of the lens holder 27, each lens fitting hole 32 of the cover 21 and each lens 26 are arranged at such a position that their centers (optical axes) respectively correspond to the center position of each LED 24 on the above-described substrate 25.

Next, as shown in FIG. 6, the supporter 13 is provided with a cylindrical shaft 74 and an arm 75 attached so as to rotate freely in the horizontal direction at the lower end of the cylindrical shaft 74. The lamp body 12 is supported at the both ends of the arm 75 so that a vertical angle can be adjusted by using a horizontal shaft.

The electric wire 15 connected to the power source unit 14 is inserted into the cylindrical shaft 74 and the electric wire 15 drawn out from the lower end of the cylindrical shaft 74 is connected to the lamp body 12.

Next, the power source unit 14 is internally provided with a lighting circuit for supplying constant electric current through the electric wire 15 to each of the LEDs 24, for example. The power source unit 14 is constituted in such a manner that power is supplied to the lighting circuit by way of a power wire by being directly attached to the surface of a ceiling or power is supplied to the lighting circuit by being installed at a wiring rail which has been attached in advance to a ceiling.

Next, as shown in FIG. 3, the electric wire 15 is an electric wire obtained by integrating, for example, a pair of power-supplying electric wires 78 and a ground wire 79 into one wire. A connector 80 connected to the connector 52 of the substrate 25 is attached at the leading end of the pair of power-supplying electric wire 78, and a metal-made ground terminal 81 is attached at the leading end of the ground wire 79. The ground terminal 81 is connected and fixed to a ground-wire attachment boss 41 protruding to the front face of the substrate 25 by using a screw 82. An electric wire holder 47 is attached to the electric wire 15 at a predetermined-length position from the leading end of the electric wire 15.

Next, a description will be given of assembly of the lamp body 12 of the illumination apparatus 11.

In a state that the front face portion 35 of the radiator 22 is pointed upward, the substrate 25, on which the LEDs 24 and others are mounted, is positioned and arranged on the front face portion 35 of the radiator 22. In this instance, the ground-wire attachment boss 41 which protrudes from the front face portion 35 of the radiator 22 is allowed to pass through the boss insertion hole 54 of the substrate 25, and the substrate 25 is fitted into the recess 35*a* at the front face portion 35 of the radiator 22 and positioned accordingly.

The lens holder 27 is arranged on the substrate 25 placed on the front face portion 35 of the radiator 22. In this instance, a plurality of positioning protrusions which protrude from the lens holder 27 are inserted into individual positioning holes 55 of the substrate 25, by which the lens holder 27 is positioned with respect to the substrate 25 and the radiator 22.

The screw 38 is inserted into a screw attachment portion 66 of the lens holder 27 and screwed by way of a screw insertion hole 65 of the screw attachment portion 66 and a screw insertion hole 53 of the substrate 25 into the screw attachment hole 39 of the radiator 22. Then, the lens holder 27 and the substrate 25 are fastened and fixed together to the radiator 22. Thereby, the rear face of the substrate 25 is firmly attached to the front face portion 35 of the radiator 22 in a surface contact state, increasing the thermal conductivity from the substrate 25 to the radiator 22.

In the above-described state, the electric wire insertion groove 57 and the covering portion 58 on the substrate 25 are arranged at a position opposing to the front face of the wiring groove 44 on the radiator 22. The wiring groove 44 is formed in such a manner that the actual front face opening 45, that is, apart corresponding to the electric wire insertion groove 57 of the substrate 25 will not directly oppose to the rear face opening 46. Further, the connector connecting opening 67 of the lens holder 27 is arranged so as to oppose to the connector 52 of the substrate 25, and the ground-wire attaching opening 68 is arranged so as to oppose to the ground-wire attachment boss 41 which protrudes on the front face of the substrate 25.

The connector 80 of the electric wire 15 is connected from the connector connecting opening 67 of the lens holder 27 to the connector 52 of the substrate 25, and the ground terminal 81 of the ground wire 79 is connected from the ground-wire attaching opening 68 of the lens holder 27 and fixed to the ground-wire attachment boss 41 by using the screw 82. The leading end of the electric wire 15 is inserted into the electric wire retaining groove 71 from the front of the lens holder 27 and retained for positioning. Further, the electric wire 15 is inserted and arranged on the wiring groove 44, while being bent externally from the radiator 22 along the inside of the wiring groove 44, by which the electric wire holder 47 is fixed to the rear face of the radiator 22 by using the screw 48.

On the other hand, with the rear face of the cover 21 directed upward, each of the lenses 26 is arranged at each of the lens fitting holes 32 on the cover 21.

The radiator 22 on which the substrate 25, the lens holder 27 and the electric wire 15 are attached is covered from above on the cover 21 in which the lenses 26 are arranged, and each of the lenses 26 is fitted into each holder portion 64 of the lens holder 27. Thereby, the cover 21 and the radiator 22 are assembled. Each of the screws 42 is fastened by way of the attachment portion 43 of the radiator 22 and fixed to the cover 21.

Thereby, each of the lenses 26 is placed and held between the cover 21 and the lens holder 27, the electric wire 15 is drawn out from an upper part between the cover 21 and the radiator 22, thereby completing assembly of the lamp body 12.

As described above, on assembling the lamp body 12, there is provided the wiring groove 44 communicatively connecting to the external face portion 36 of the radiator 22 from the external face portion 36 to the front face portion 35. Therefore, it is sufficient that the electric wire 15 connecting to the substrate 25 is only arranged on the wiring groove 44 from outside the radiator 22, thus making it possible to eliminate such conventional troublesome work that an electric wire is allowed to pass through an electric wire insertion hole and also improve the assembly work.

Then, in the illumination apparatus 11 using the above-described lamp body 12, the power source unit 14 is attached to a ceiling. With regard to the power source unit 14, the lamp body 12 is supported by the cylindrical shaft 74 and the arm 75.

Power is supplied to a lighting circuit of the power source unit 14, by which power is supplied from the lighting circuit through the electric wire 15 to the LEDs 24. Thereby, each of the LED 24 emits light, and light emitted from each LED 24 is projected through each of the lenses 26 from the front of the lamp body 12.

On lighting the lamp body 12, since the wiring groove 44 is provided on the radiator 22, there is a possibility that light may leak from the wiring groove 44. However, the front face opening 45 and the rear face opening 46 of the wiring groove 44 are positioned so as not to oppose to each other in the front-rear direction, thus, making it possible to reduce leakage of light from the wiring groove 44.

In particular, where only the radiator 22 is taken into account in an attempt to allow the front face opening 45 and the rear face opening 46 of the wiring groove 44 so as not to oppose to each other in the front-rear direction, a mold for forming the wiring groove 44 of the radiator 22 becomes complicated to raise the cost of the radiator 22. However, the wiring groove 44 is provided on the radiator 22 approximately in an L-letter shape and the front face of the wiring groove 44 is covered with the covering portion 58 of the substrate 25. The above-described structure makes it possible to produce the radiator 22 at lower cost without complicating the mold for forming the wiring groove 44 of the radiator 22.

Further, heat generated when each of the LEDs 24 emits light is efficiently transferred mainly from the substrate 25 to the radiator 22 and released into the air from a plurality of heat releasing fins 49 of the radiator 22.

Still further, a direction of the front face of the lamp body 12, that is, a light irradiating direction, can be changed and adjusted horizontally and vertically by using the supporter 13.

In this instance, the wiring groove 44 is provided at an upper part of the radiator 22. Therefore, if the lamp body 12 is moved to adjust a vertical angle with respect to the supporter 13, it is possible to prevent the electric wire 15 drawn out from the wiring groove 44 from interfering with the heat releasing fins 49 installed at the rear of the radiator 22.

Further, the heat releasing fins 49 of the radiator 22 are installed along the vertical direction. Thereby, if the lamp body 12 is moved to adjust the vertical angle with respect to the supporter 13, convections develop which flow along the vertical direction between the heat releasing fins 49, thus making it possible to maintain high heat-releasing effects.

Still further, where the front face of the lamp body 12 in the illumination apparatus 11 arranged at a higher position on the ceiling is directed downward obliquely and used for illuminating an illumination object such as a wall surface, a distance between the front face of the lamp body 12 and the illumination object is shorter at an upper part of the illumination object and longer at a lower part thereof. Therefore, it tends to be dark at the lower part of the illumination object. In the illumination apparatus 11 of the present embodiment, the LEDs 24 are mounted more densely at the lower part of the substrate 25 than at the upper part thereof. Thereby, a value of light flux emitted from the lower part of the front face of the lamp body 12 to the lower part of an illumination object is greater than a value of light flux emitted from the upper part thereof to the upper part of the illumination object. Therefore, it is also possible to make bright the lower part of the illumination object which is longer in distance from the lamp body 12 and make uniform illumination intensity both at the upper and the lower positions of the illumination object.

In addition, as shown in FIG. 2, in the screw 38 for fastening the lens holder 27 and the substrate 25 together with the radiator 22, the shank 38*a* thereof is inserted through the screw insertion hole 65 of the screw attachment portion 66 of the lens holder 27 and the screw insertion hole 53 of the substrate 25 and attached to the front face portion 35 of the radiator 22, whereas the head 38*b* thereof is kept in contact with the front face of the intervention portion 70 at the screw attachment portion 66 of the lens holder 27 and arranged inside the enclosing portion 69.

Therefore, where a current-carrying part such as a wiring layer formed on the front face of the substrate 25 is set at a position away from the screw 38 by a predetermined insulation distance L in a direction parallel to the front face of the substrate 25, the current-carrying part may be set at a position P1 spaced away by the insulation distance L on the basis of the shank 38*a* of the screw 38.

Where the head 38*b* of the screw 38 is in contact with the substrate 25 as in a conventional case, the current-carrying part is required to be set at a position P2 spaced away by the insulation distance L on the basis of the head 38*b* of the screw 38.

Therefore, in the present embodiment, it is possible to bring closer a distance between the screw 38 and the current-carrying part of the substrate 25 in a direction parallel to the front face of the substrate 25 than a conventional distance between the screw 38 and the current-carrying part of the substrate 25.

As described so far, according to the illumination apparatus 11 of the present embodiment, the screw 38 is attached from the front face of the attachment base 63 of the lens holder 27 by way of the attachment base 63 to the front face portion 35 of the radiator 22. Therefore, it is possible to downsize the substrate 25, with insulation kept between the screw 38 and the current-carrying part of the substrate 25, and it is also possible to downsize the illumination apparatus 11.

In particular, the periphery of the screw 38 is enclosed by the enclosing portion 69 of the screw attachment portion 66 installed on the attachment base 63 of the lens holder 27, and the intervention portion 70 of the screw attachment portion 66 is placed between the screw 38 and the substrate 25, thus making it possible to insulate the screw 38 reliably.

Further, the wiring groove 44 communicatively connecting from the external face portion 36 to the front face portion 35 is provided at the external face portion 36 of the radiator 22. Therefore, it is sufficient on assembly that the electric wire 15 connecting to the substrate 25 is only arranged on the wiring groove 44 from outside the radiator 22. Thus, it is possible to improve the assembly work.

Since the front face opening 45 and the rear face opening 46 of the wiring groove 44 are positioned so as not to oppose to each other in the front-rear direction, it is possible to reduce leakage of light from the wiring groove 44.

The wiring groove 44 is provided at an upper part of the radiator 22. Thereby, if the lamp body 12 is moved to adjust an angle with respect to the supporter 13, it is possible to prevent the electric wire 15 drawn out from the wiring groove 44 from interfering with the heat releasing fins 49 installed at the rear of the radiator 22.

The LEDs 24 are mounted more densely at the lower part of the substrate 25 than at the upper part thereof to give a greater value of light flux emitted from the lower part of the lamp body 12 than a value of light flux emitted from the upper part thereof. It is, thus, possible to make uniform illumination intensity both at the lower and upper positions of an illumination object when the front face of the lamp body 12 is directed downward obliquely.

Figure 7:
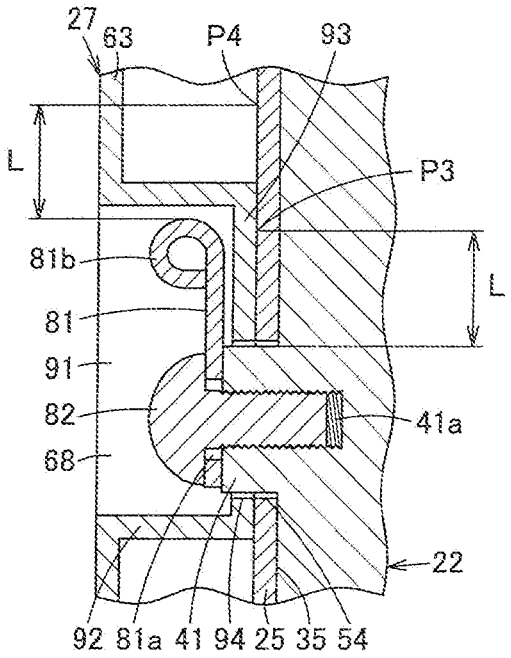
FIG. 7 is a cross sectional view which shows a part of an illumination apparatus of a second embodiment.

Next, a description will be given of the second embodiment with reference to FIG. 7. It is noted that the same constitution as that of the first embodiment will be given the same reference numerals to omit a description thereof.

A ground terminal 81 as a metal component is to be explained. The ground terminal 81 is provided at one end with a screw insertion hole 81*a* through which a screw 82 is inserted and at the other end with a ground wire binding portion 81*b* which protrudes laterally and which is joined by clamping a ground wire 79.

A ground terminal accommodating portion 91 as a metal component attachment portion is installed at a position where the ground terminal attaching opening 68 of the lens holder 27 is situated. The ground terminal accommodating portion 91 is provided with an enclosing portion 92 for enclosing the periphery of the ground terminal 81 and an intervention portion 93 which is placed between the ground terminal 81 and the substrate 25 at the bottom of the enclosing portion 92. In the intervention portion 93, there is formed a boss insertion hole 94 through which the ground-wire attachment boss 41 of the radiator 22 is inserted to protrude to the front face of the intervention portion 93.

The enclosing portion 92 is formed at a recess which is in a long hole shape or a rectangular shape according to the shape of the ground terminal 81. The ground terminal 81 can be regulated for positioning thereof in a direction of rotation around the screw 82 by a contact thereof with the inner wall surface of the enclosing portion 92.

A protruding distance of the ground-wire attachment boss 41 from the front face portion 35 of the radiator 22 is made greater than the combined thickness of the substrate 25 and the intervention portion 93.

Then, the ground terminal 81 is inserted into the ground terminal accommodating portion 91 from the front face of the lens holder 27, and the screw 82 inserted through the screw insertion hole 81*a* is screwed into the ground-wire attachment hole 41*a* of the ground-wire attachment boss 41 and connected and fixed to the ground-wire attachment boss 41.

The ground terminal 81 connected and fixed to the ground-wire attachment boss 41 is enclosed by the enclosing portion 92 of the ground terminal accommodating portion 91, and the intervention portion 93 is placed between the substrate 25 and the ground terminal 81.

Therefore, where a current-carrying part such as a wiring layer formed on the front face of the substrate 25 is set at a position away from a part of the ground terminal 81 by a predetermined insulation distance L in a direction parallel to the front face of the substrate 25, the current-carrying part may be set at a position P3 spaced away by the insulation distance L on the basis of the ground-wire attachment boss 41.

Where the ground terminal 81 directly opposes to the front face of the substrate 25 as in a conventional case, the current-carrying part is required to be set at a position P4 spaced away by the insulation distance L on the basis of the end of the ground wire binding portion 81*b* of the ground terminal 81 protruding laterally to a greater extent than the ground-wire attachment boss 41.

Therefore, in the present embodiment, it is possible to bring closer a distance between the part of the ground terminal 81 and the current-carrying part of the substrate 25 in a direction parallel to the front face of the substrate 25 than a conventional distance between the part of the ground terminal 81 and the current-carrying part of the substrate 25.

As described above, the ground terminal 81 is attached from the front face of the attachment base 63 of the lens holder 27 by way of the attachment base 63 to the front face portion 35 of the radiator 22. Therefore, it is possible to downsize the substrate 25, with insulation kept between the ground terminal 81 and the current-carrying part of substrate 25, and it is also possible to downsize the illumination apparatus 11.

In particular, the periphery of the ground terminal 81 is enclosed by the enclosing portion 92 of the ground terminal accommodating portion 91 installed on the attachment base 63 of the lens holder 27, and the intervention portion 93 of the ground terminal accommodating portion 91 is placed between the ground terminal 81 and the substrate 25, thus making it possible to insulate the ground terminal 81 reliably.

The ground terminal 81 connected and fixed to the ground-wire attachment boss 41 is not in contact with the intervention portion 93 but connected to the radiator 22 to have only ground functions. Thus, the ground terminal 81 is not provided with functions to attach the substrate 25 and the lens holder 27. This is based on a standard that the ground functions shall not have other functions at the same time.

The wiring groove 44 of the radiator 22 may be provided in any shape such as a linear shape and a curved shape as long as it is able to arrange the electric wire 15. Further, the wiring groove 44 may be provided at an upper part of the radiator 22 or at any other places, as long as it can be provided on an external face portion of the radiator 22.

Further, in order that the front face opening 45 and the rear face opening 46 of the wiring groove 44 are positioned so as not to oppose to each other in the front-rear direction, the wiring groove 44 may be formed approximately in an L-letter shape or in an S-letter shape.

Still further, the supporter 13 may, be attached to the lamp body 12 in such a manner as to change a vertical direction of the lamp body 12 and also as to change a horizontal direction thereof.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An illumination apparatus comprising:

a substrate comprising a wiring layer formed on a front face of the substrate;

a plurality of semiconductor light emitting elements mounted at least on a peripheral portion of the front face of the substrate;

a connector formed on the front face of the substrate and extending from the front face away from the substrate and radially inward from at least the plurality of semiconductor light emitting elements mounted on the peripheral portion;

an electrical wire electrically connected to the connector and projecting outward from the substrate;

a radiator to which a rear face of the substrate is attached;

an insulative attachment body comprising:

a lens which is configured to focus light emitted from the semiconductor light emitting element; and an attachment base attached to the radiator and configured to hold the substrate between the attachment body and the radiator;

a metal component which is attached to the radiator from a front face of the attachment base of the attachment body; wherein the substrate includes a covering portion;

a wiring groove in the radiator includes a front face opening and a rear face opening; the groove being an "L" shape so that the rear face opening and the front face opening are not opposed; the covering portion covering at least a portion of the front face opening of the wiring groove.

2. The illumination apparatus according to claim 1, further comprising:

an enclosing portion which encloses a periphery of the metal component, the enclosing portion being installed on the attachment base of the attachment body; and a metal component attachment portion comprising an intervention portion placed between the metal component and the substrate, the metal component attachment portion being installed on the attachment base of the attachment body.

3. The illumination apparatus according to claim 1, wherein:

the metal component is a screw comprising a shank and a head;

the shank of the screw penetrates through the attachment base of the attachment body and is attached to the radiator; and the head of the screw is in contact with and arranged on the front face of the attachment base of the attachment body.

4. The illumination apparatus according to claim 1, wherein the radiator is made of metal, and further comprising:

a ground-wire attachment portion installed on the front face of the attachment base, the ground wire attachment portion penetrating through the substrate and the attachment base of the attachment body to protrude from the front face of the attachment base, and a ground terminal which is attached to the ground-wire attachment portion protruding from the front face of the attachment base of the attachment body.

5. The illumination apparatus according to claim 1, wherein the radiator comprises:

a front face portion to which the substrate is attached; and an external face portion adjacent to the front face portion and provided at the external face portion, the external face portion comprising a wiring groove communicatively connecting from the external face portion to the front face portion; and wherein the illumination apparatus is configured so that an electric wire is electrically connected to the connector by way of the wiring groove of the radiator to the substrate.

6. The illumination apparatus according to claim 5, wherein the wiring groove of the radiator comprises:

a front face opening which is opened at the front face portion of the radiator; and a rear face opening which is opened at a rear of the radiator;

wherein the front face opening and the rear face opening are positioned so as not to oppose to each other in a front-rear direction.

7. A device comprising:

a lamp body comprising a front face;

the illumination apparatus according to claim 5 disposed in the lamp body so that the semiconductor light emitting element is configured to emit light in a direction so that the light exits via the front face of the lamp body; and a supporter configured for supporting the lamp body in such a manner that an orientation of the front face of the lamp body is adjustable in a vertical direction, wherein the wiring groove is installed at an upper part of the radiator and a plurality of heat releasing fins are installed at the rear of the radiator.

8. The illumination apparatus according to claim 7, wherein a plurality of semiconductor light emitting elements are mounted on the substrate and the semiconductor light emitting elements are mounted more densely at a lower part of the substrate than at an upper part of the substrate.

* * * * *